US010683715B2

(12) United States Patent
Couturier et al.

(10) Patent No.: US 10,683,715 B2
(45) Date of Patent: Jun. 16, 2020

(54) PROPORTIONAL CONTROL OF RIG DRILLING MUD FLOW

(71) Applicant: Schlumberger Technology Corporation, Sugar Land, TX (US)

(72) Inventors: Yawan Couturier, Katy, TX (US); Paul Andrew Thow, Spring, TX (US); Blaine Dow, Sugar Land, TX (US); Jesse Alan Hardt, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 131 days.

(21) Appl. No.: 15/753,547

(22) PCT Filed: Aug. 29, 2016

(86) PCT No.: PCT/US2016/049173
§ 371 (c)(1),
(2) Date: Feb. 19, 2018

(87) PCT Pub. No.: WO2017/040361
PCT Pub. Date: Mar. 9, 2017

(65) Prior Publication Data

US 2018/0238130 A1 Aug. 23, 2018

Related U.S. Application Data

(60) Provisional application No. 62/212,804, filed on Sep. 1, 2015.

(51) Int. Cl.
*E21B 21/08* (2006.01)
*F04D 7/02* (2006.01)
(Continued)

(52) U.S. Cl.
CPC ..... *E21B 21/08* (2013.01); *E21B 21/106* (2013.01); *E21B 47/06* (2013.01); *E21B 47/065* (2013.01);
(Continued)

(58) Field of Classification Search
USPC ..... 175/48
See application file for complete search history.

(56) References Cited

U.S. PATENT DOCUMENTS 6,904,981 B2 6/2005 Van Riet
7,562,723 B2 * 7/2009 Reitsma ..... E21B 21/08 175/72
(Continued)

OTHER PUBLICATIONS

International Search Report and Written Opinion for the equivalent International patent application PCT/US2016/049173 dated Dec. 2, 2016.
(Continued)

*Primary Examiner* — Taras P Bemko
*Assistant Examiner* — Ronald R Runyan
(74) *Attorney, Agent, or Firm* — Jeffrey D. Frantz

(57) ABSTRACT

A system includes a mud pump for pumping a drilling mud from a drilling mud source, through a drill string, out a drill bit and into an annular, and a plurality of chokes disposed down stream from the mud pump, including a first choke disposed between the mud pump and the drill string, and a second choke disposed between the mud pump and a mud tank. The system further includes a fluid discharge conduit in fluid communication with the annular space for transferring the drilling mud to handling equipment in fluid communication with the mud tank. The first choke receives the drilling mud from the mud pump at a first flow rate, the first choke reduces drilling mud flow rate to a second flow rate less than the first flow rate, and the second choke reduces drilling mud flow rate to a third flow rate.

18 Claims, 2 Drawing Sheets

(51) Int. Cl.

| | |
|---|---|
| ***F04D 15/00*** | (2006.01) |
| ***E21B 21/10*** | (2006.01) |
| ***E21B 47/06*** | (2012.01) |
| *F04D 13/10* | (2006.01) |
| *E21B 21/06* | (2006.01) |
| *E21B 21/00* | (2006.01) |

(52) U.S. Cl.
CPC ..... *F04D 7/02* (2013.01); *F04D 15/0022* (2013.01); *E21B 21/065* (2013.01); *E21B 2021/006* (2013.01); *F04D 13/10* (2013.01)

(56) References Cited

U.S. PATENT DOCUMENTS

| | | | | |
|---|---|---|---|---|
| 2003/0062199 | A1* | 4/2003 | Gjedebo ..... | E21B 21/001 175/66 |
| 2006/0207795 | A1 | 9/2006 | Kinder et al. | |
| 2010/0186960 | A1 | 7/2010 | Reitsma et al. | |
| 2010/0288507 | A1 | 11/2010 | Duhe et al. | |
| 2012/0241163 | A1 | 9/2012 | Reitsma et al. | |

OTHER PUBLICATIONS

Examination Report for the equivalent Canadian patent application 2996170 dated Apr. 4, 2019.

International Preliminary Report on Patentability for the equivalent International patent application PCT/US2016/049173 dated Mar. 15, 2018.

* cited by examiner

PROPORTIONAL CONTROL OF RIG DRILLING MUD FLOW

CROSS-REFERENCE TO RELATED APPLICATION

The present document is based on and claims priority to U.S. Provisional Application Ser. No. 62/212,804, filed Sep. 1, 2015, which is incorporated herein by reference in its entirety.

BACKGROUND

This section provides background information to facilitate a better understanding of the various aspects of the disclosure. It should be understood that the statements in this section of this document are to be read in this light, and not as admissions of prior art.

The exploration and production of hydrocarbons from subsurface formations requires methods to reach and extract the hydrocarbons from the formation. This is typically done with a drilling rig. In its simplest form, this constitutes a drilling rig that is used to support a drill bit mounted on the end of drill string, comprised of a series of drill tubulars. A fluid including a base fluid, typically water or oil, and various additives, is pumped down the drill string by one or more mud pumps, and exits through the rotating drill bit. The fluid then circulates back up the annulus formed between the borehole wall and the drill bit, carrying with it the cuttings from the drill bit and clearing the borehole. In some cases, the fluid is also selected such that the hydrostatic pressure applied by the fluid is greater than surrounding formation pressure, thereby preventing formation fluids from entering into the borehole. It also causes the fluid to enter into the formation pores, or "invade" the formation. Further, some of the additives from the pressurized fluid adhere to the formation walls forming a "mud cake" on the formation walls. This mud cake helps to preserve and protect the formation prior to the setting of casing in the drilling process, as will be discussed further below.

The selection of fluid pressure in excess of formation pressure is commonly referred to as over balanced drilling, while in other cases, fluid pressure is lower than formation pressure in so called underbalanced drilling. The fluid then returns to the surface, where it is bled off into a mud system, generally comprised of a shaker table, to remove solids, a mud pit and a manual or automatic means for addition of various chemicals or additives to the returned fluid. The clean, returned fluid flow is measured to determine fluid losses to the formation as a result of fluid invasion. The returned solids and fluid (prior to treatment) may be studied to determine various formation characteristics used in drilling operations. Once the fluid has been treated in the mud pit, it is then pumped out of the mud pit and re-injected into the top of the drill string again.

Often, in some drilling operations, the mechanical pumps used to pump drilling mud to the drill string are mechanical pumps which operate at high minimum output force, which delivers too high of drill mud flow rate. This can cause issues when a heavier mud is required in order to balance the well, or achieve target drill mud pressure in the borehole. If the borehole has a narrow window between pore and fracture gradients, then minimum stroke rate of a pump may not provide the necessary resolution for the lower flow that is required. If the hydrostatic pressure is already near the fracture gradient then the minimum stroke rate may be too high for the formation to withstand, and the formation may be otherwise fractured or borehole damaged. In such scenarios, using a mechanical pumps with these limitations, may result in the drill rig not effectively drilling a borehole with optimum integrity. Thus, there exists a need for systems and methods for drilling a borehole with optimum integrity using existing drill rig apparatus and techniques, the need met at least in part, by embodiments according to the following disclosure.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DESCRIPTION

Figure 1:
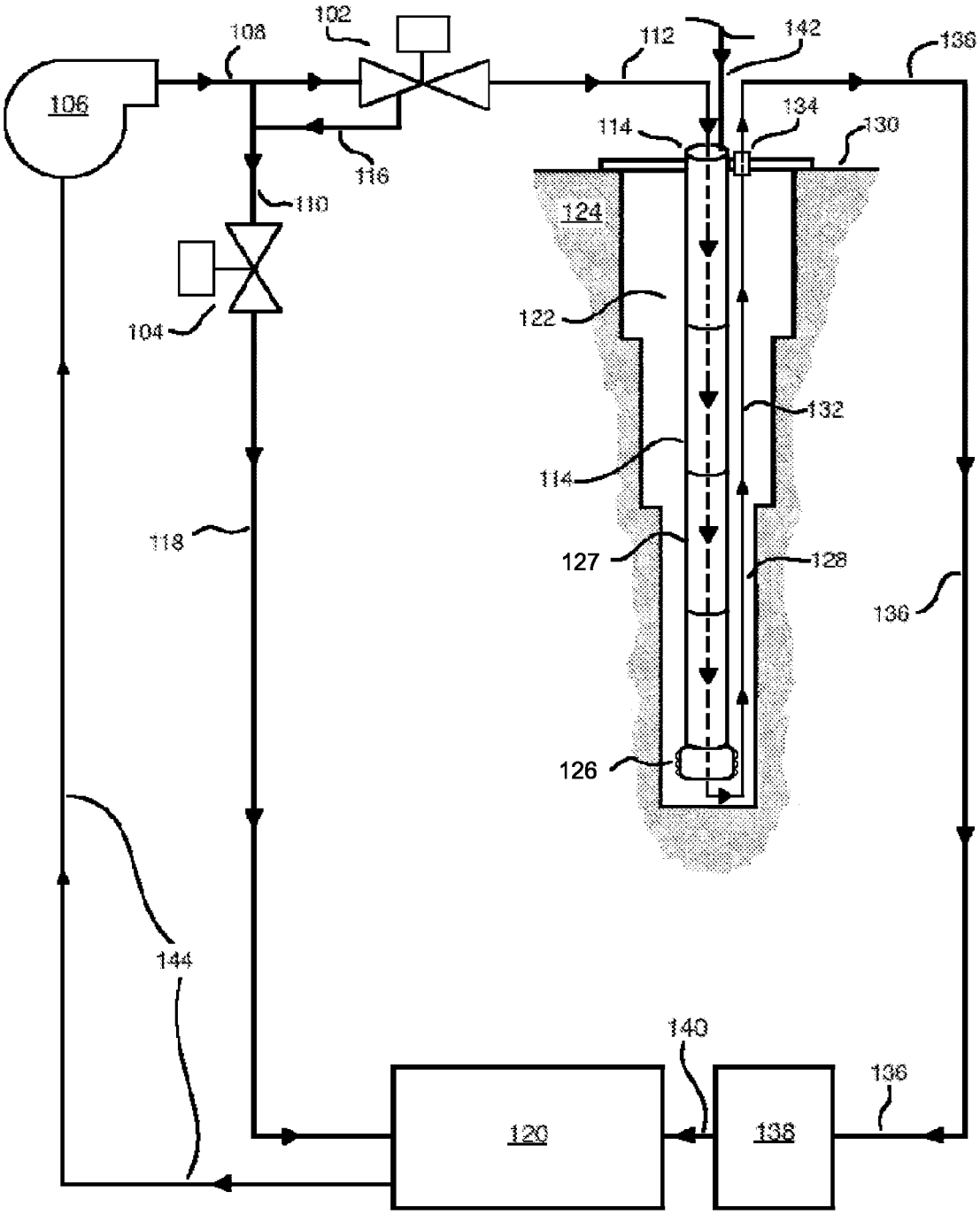
FIG. 1 illustrates a drilling mud flow rate control system in accordance with an aspect of the disclosure; and, FIG. 2 depicts drilling mud flow rate control system in accordance with another aspect of the disclosure.

The following description of the variations is merely illustrative in nature and is in no way intended to limit the scope of the disclosure, its application, or uses. The description and examples are presented herein solely for the purpose of illustrating the various embodiments and should not be construed as a limitation to the scope and applicability of such. Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present). In addition, use of the "a" or "an" are employed to describe elements and components of the embodiments herein. This is done merely for convenience and to give a general sense of concepts according to the disclosure. This description should be read to include one or at least one and the singular also includes the plural unless otherwise stated. The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited. Also, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

The process of drilling in some aspects involves managed pressure drilling ("MPD"), an adaptive drilling process used to precisely control the annular pressure profile throughout the wellbore. The objectives are to ascertain the downhole-pressure-environment limits and to manage the annular hydraulic pressure profile accordingly. The intention of MPD is to avoid continuous influx of formation fluids to the surface. Any influx incidental to the operation is safely contained using appropriate methods and apparatus. MPD systems are normally closed and pressurized circulating systems, which facilitate precise management of wellbore pressure profile. In an open system the drilling fluids piping are open to atmospheric pressure, whilst for a closed system drilling fluids flow under pressure. The main benefit by utilizing MPD is the ability to control the pressure dynamically by manipulating the back pressure instead of the mud weight. This optimizes the drilling process by reducing the NPT, mitigating drilling hazards and enabling drilling in more complex areas. Adjustment of the choke enables a rapid change of BHP (in the manner of minutes compared to hours which is needed for conventional MW change), and thereby provides a safer way to control influxes and their subsequent bleed downs. Well control is maintained by using independent well barriers. For a typical MPD system the primary barrier will be a rotating blow out preventer ("BOP") whereas the secondary barrier will be the BOP. Comparing this to conventional techniques where drilling fluid is used as primary barrier and BOP as secondary barrier, MPD is in general a more secure way of drilling in certain environments.

An objective of MPD is to drill as close the pore pressure as possible and thereby reduce the dynamic overbalance. A reduction in dynamic overbalance often helps to increase the rate of penetration ("ROP"), decrease surge and swab effects, reduce influx, and enhance well control (kicks, lost circulation). Lowering dynamic overbalance reduces the differential pressure in the well. As differential pressure is lowered, the force needed to break/cut rock is lowered increasing ROP. Circulation rate is often lowered to reduce friction in the well. The combination of an increased ROP and reduced circulation rate may result in problems such as peak-off in the annulus, high torque and drag, and even worse stuck pipe, twists off and so on.

A MPD set-up may include a hydraulic model based on real time data which controls choke(s) that handle pressure variations. A combination of the MPD system and continuous circulation system ("CCS") complement each other yielding better bottom hole pressure ("BHP") control. The CCS compensates for the large pressure variations during connections caused by mud pump cycling, improves the cuttings transport, reduces connection gas and borehole ballooning, and increases the hydraulic stability in the well.

In addition to mud pumps, drill strings, shakers, mud pits, and the like, MPD operations require some additional equipment to that of a conventional drilling operation. The system is not designed for continuous influx and the rig up is fairly simple compared to a UBD rig up. If the well requires a closed-loop system a rotating control device ("ROD") is installed. A choke skid may be used to adjust the backpressure, an annular seal to provide the back pressure and a control system to adjust the choke itself. In addition, the use of a back pressure pump to adjust the pressure without circulation, a flow meter to detect kicks and losses, and a CCS to provide circulation during tubular connections. MPD technology and equipment complements and enhance the capabilities of the existing conventional well control system.

In comparison with MPD, under balanced drilling ("UBD") is basically intentionally drilling below the pore pressure, and intentionally producing while drilling. Advantages of UBD are typically higher ROP, reduced risk of formation fracturing, differential sticking and skin damage. When drilling underbalanced the hydrostatic head is lower than the formation pressure, i.e. the drilling fluid do not act as a well barrier and formation fluids are thereby allowed to flow continuously into the wellbore during operations. In UBD it the intent is to manage influx continuously and bring the formation fluids to the surface, thereby no near wellbore damage occur and losses are avoided. Differential sticking issues are eliminated as no mud cake forms. Drilling fluids used in UBD are relatively light, thereby increasing the ROP as well reducing wear on bit. It is easier to detect and characterize reservoir zones when using UBD, and thereby often enhances recovery and production.

In UBD operations, a technique to achieve hydrostatic head lower than the formation pressure, one primary method used to drill underbalanced is gas injection. This approach decreases the density of the drilling fluid and creates a condition where the bottom hole pressure ("BHP") is less than the formation pressure. When the BHP is less than formation pressure, formation fluids are able to enter the well bore, and in effect become produced fluids. Gas is injected into the well either through the drill string or into the well annulus using a string (i.e. casing, tubing, etc.). A UBD operation must be designed to achieve underbalanced conditions throughout the entire drilling and completion operation. If underbalance is not maintained, problems associated with well bore instability may occur.

In some MPD and UBD operations, or portions of these operations, drilling mud flow rates may vary, and in some instances some mechanical mud pumps cannot effectively operate at adequately low flow rates, when low flow rates are required. Such circumstances may cause issues when higher density or otherwise heavier mud is required in order to balance the well. For example, a mechanical mud pump that has a minimum flow rate of 50 strokes per minute might cause too much pressure to be exerted on the wellbore. If the well has a narrow window between the pore and fracture gradients then the minimum stroke rate of a pump may not provide the necessary resolution for flow that is required. If the hydrostatic pressure is already near the fracture gradient then the minimum stroke rate may be too high for the formation to withstand. Given this scenario, any rig using a mechanical pump with these limitations, will cause the rig's potential use to decline.

Some embodiments according to the disclosure involve the use of a plurality of control chokes to proportionally control the flow from the rig mud pump(s) in order to achieve lower flow rates than are possible with some mechanical mud pumps, when used in MPD or UBD operations. In an embodiment, two control chokes are disposed directly downstream of the pumps. The control chokes, or another proportional flow device, would be used to control the amount of flow going down-hole while keeping the pump rate constant. Introducing the process of proportionally controlling the flow from the rig pumps can circumvent this issue and reestablish the rig's potential for future use. This design would allow the driller to keep the pumps on while still allowing the ability to decrease the flow. The flow would be diverted to the mud tanks or another system such as an MPD manifold, thereby decreasing the flow rate into the well and keeping the bottom-hole pressure below the fracture gradient.

With reference to FIG. 1, in an embodiment, two control chokes, 102 and 104, are disposed downstream of mud pump 106. Drilling mud may be prepared according to conventional practice and delivered to mud pump 106. Mud pump 106 delivers drilling mud through conduits to chokes 102 and 104 at a first pressure and first flow rate, in directions 108 and 110. Upon passing through choke 102, drilling mud pressure and flow rate is reduced to a second rate at a second pressure, and travels through a conduit in direction 112, to drill string 114. Also, after passing through choke 104, drilling mud pressure and flow rate is reduced to a third rate at a third pressure, and travels through a conduit in direction 118, to mud tank(s) 120. Optionally, in some aspects, an excess portion of drilling mud, not delivered to the drill string from choke 102 is sent to choke 104 in direction 116 and 110 through conduits. The sum of the second flow rate and the third flow rate may, in some cases, may be at least substantially equal to the first flow rate.

Drill string 114 is rotated in wellbore 122 penetrating subterranean formation 124, and drilling of the formation is conducted by rotation of drill bit 126, disposed at a distal end of drill string 114. Drill string 114 also includes tubulars 127 (four shown), and rotation of drill string 114 may be conducted by techniques and equipment readily known to those of skill in the art. Drilling mud is forced through drill string 114 and out drill bit 126 at second rate and second pressure, and enters annulus 128 formed between drill string 114 and wellbore wall. Travelling toward surface 130, in direction 132, drilling mud carries drill cuttings out of the wellbore through port 134. Pressure in the well is maintained at a suitable pressure for either a MPD or UBD operation. In some aspects, mud pump 106 may be a conventional mud pump with a minimum first rate of flow which exceeds the targeted second rate of flow of drilling mud after passing through choke 102.

After leaving wellbore 122, drill cutting laden drilling mud travels through conduits in direction 136, to mud handling equipment 138. Mud handling equipment 138 may include such apparatus as shakers, desanders, desilters, trip tanks, flow ditch, header boxes, centrifuges, gas flow meters, and/or degassers, and the like, before transferring drilling mud to mud tank(s) 120, through a conduit in direction 140. Drilling cuttings are otherwise discharged from mud handling equipment 138, at least substantially separated from the drilling mud transferred to mud tank(s) 120 in direction 140. Drilling mud may be supplied to mud pump 106 from mud tank(s) 120 through conduits in direction 144.

In some embodiments, equipment 138 may further include fluid backpressure system components, such as an automated choke manifold, a pressure relief choke, an automated back pressure pump, a HPU module, control module, low pressure automated choke console, data acquisition equipment, a real-time hydraulics model, and/or a human machine interface, and the like. In some instances, where the operation is UBD, a gas component may be injected into the drill string or conduit at 142, and mixed with the mud in order to decrease the density of the drilling mud.

Figure 2:
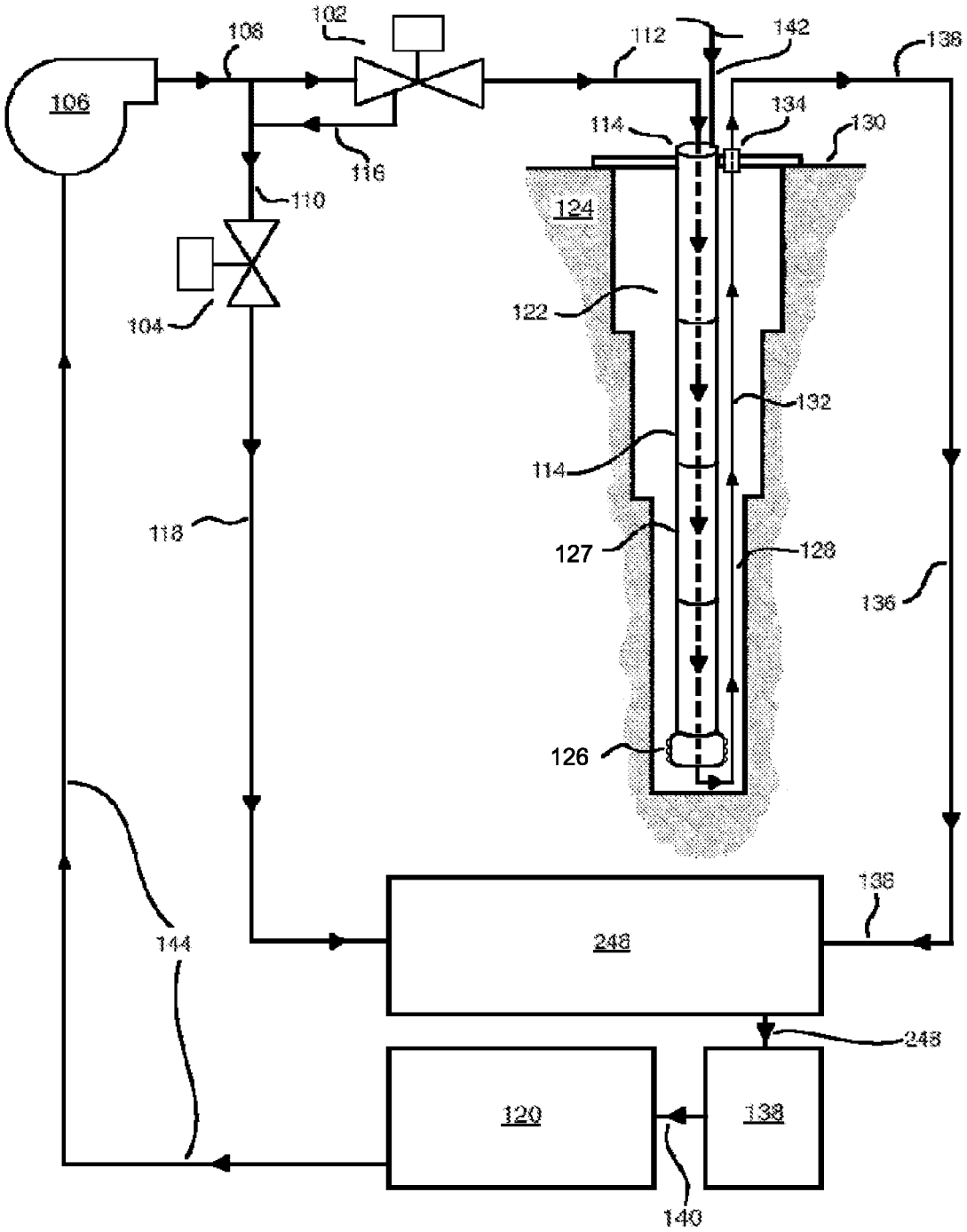

In another embodiment, illustrated in FIG. 2, the system operates in similar fashion as that depicted in FIG. 1, except after passing through choke 104, drilling mud at a third flow rate at a third pressure, and travels through a conduit in direction 118 to an automated choke manifold located in a fluid backpressure system 246. Also, drill cutting laden drilling mud travels through conduits in direction 136 to the automated choke manifold located in the drilling pressure control system, as well. The combined drilling mud then is transferred from the fluid backpressure system to mud handling equipment 136 by a conduit in direction 248.

Chokes useful in embodiments of the disclosure include those devices incorporating an orifice that is used to control fluid flow rate or downstream system pressure. Chokes are available in several configurations for both fixed and adjustable modes of operation, and even in some cases, automatic adjustability. Adjustable chokes enable the fluid flow and pressure parameters to be changed to suit process or production requirements. Fixed chokes do not provide this flexibility, although they are more resistant to erosion under prolonged operation or production of abrasive fluids. In some aspects, a set of high-pressure valves and associated piping may be used that include at least two adjustable chokes, arranged such that one adjustable choke may be isolated and taken out of service for repair and refurbishment while well flow is directed through the other one.

Methods and apparatus according to the disclosure may be used with any suitable type of drilling mud. Some wells require that different types be used at different parts in the hole, or that some types be used in combination with others. Nonlimiting examples of drilling mud include water-based mud ("WBM"), oil-based mud ("OBM"), foamed drilling fluids, synthetic-based fluid ("SBM"), and the like. For WBM, as most basic water-based mud systems begin with water and then clays and other chemicals are incorporated into the water to create a homogeneous viscous blend. The clay is often a combination of native clays that are suspended in the fluid while drilling, or specific types of clay that are processed or synthesized as additives for the WBM system. The most common of these is bentonite, frequently referred to in the oilfield as "gel". Gel likely makes reference to the fact that while the fluid is being pumped, it can be very thin and free-flowing, however when pumping is stopped, the static fluid builds a gel structure that resists flow. When an adequate pumping force is applied to break the gel, flow resumes and the fluid returns to its previously free-flowing state. Many other chemicals (e.g. potassium formate) are added to the WBM system to achieve various effects, including viscosity control, shale stability, enhance drilling rate of penetration, cooling and lubricating of equipment.

OBM is a mud where the base fluid is a petroleum product such as diesel fuel. OBMs are used for many reasons, including increased lubricity, enhanced shale inhibition, and greater cleaning abilities with less viscosity. OBMs also withstand greater heat without breaking down. SBM, otherwise known as Low Toxicity Oil Based Mud or LTOBM, is a mud where the base fluid is a synthetic oil. This is most often used on offshore rigs because it has the properties of an oil-based mud, but the toxicity of the fluid fumes are much less than an oil-based fluid.

The foregoing description of the embodiments has been provided for purposes of illustration and description. Example embodiments are provided so that this disclosure will be sufficiently thorough, and will convey the scope to those who are skilled in the art. Numerous specific details are set forth such as examples of specific components, devices, and methods, to provide a thorough understanding of embodiments of the disclosure, but are not intended to be exhaustive or to limit the disclosure. It will be appreciated that it is within the scope of the disclosure that individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Also, in some example embodiments, well-known processes, well-known device structures, and well-known technologies are not described in detail. Further, it will be readily apparent to those of skill in the art that in the design, manufacture, and operation of apparatus to achieve that described in the disclosure, variations in apparatus design, construction, condition, erosion of components, gaps between components may present, for example.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly. In the figures illustrated, the orientation of particular components is not limiting, and are presented and configured for an understanding of some embodiments of the disclosure.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system comprising:

a drill string extending into a borehole defined by a formation, the drill string including a bottom hole assembly comprising a drill bit and at least one tubular;

a mud pump for pumping a drilling mud from a drilling mud source, through the drill string, out the drill bit and into an annular space created as the drill string penetrates the formation;

a plurality of chokes disposed down stream from the mud pump, the plurality of chokes comprising a first choke disposed between the mud pump and the drill string, and a second choke disposed between the mud pump and a mud tank; and, a fluid discharge conduit in fluid communication with the annular space for transferring the drilling mud to mud handling equipment in fluid communication with the mud tank;

wherein the first choke receives a first portion of the drilling mud from the mud pump at a first flow rate, wherein the first choke reduces the first flow rate of the first portion of the drilling mud to a second flow rate, wherein the second choke receives a combined flow of (i) a second portion of the drilling mud from the mud pump at the first flow rate, the second portion of the drilling mud bypassing the first choke from the mud pump, and (ii) a portion of the first portion of the drilling mud after exiting the first choke and bypassing the drill string, and wherein the second choke reduces a flow rate of the combined flow to a third flow rate.

2. The system of claim 1 further comprising a fluid backpressure system connected to the fluid discharge conduit, the fluid backpressure system comprised of a flow meter, a fluid choke, a backpressure pump, a drilling mud source, wherein the backpressure pump may be selectively activated to increase annular space drilling mud pressure.

3. The system of claim 2 wherein the second choke transfers the drilling mud at the third flow rate to the fluid backpressure system prior to the mud handling equipment and the mud tank.

4. The system of claim 1 wherein the bottom hole assembly further comprises sensors, and a telemetry system capable of receiving and transmitting data, including sensor data including at least pressure and temperature data, and the system further comprises a surface telemetry system for receiving data and transmitting commands to the bottom hole assembly.

5. The system of claim 1 wherein the mud tank is the mud source.

6. The system of claim 1 further comprising a gas source in fluid communication with the drilling mud at the second flow rate.

7. The system of claim 1 wherein the system is a closed and pressurized circulating system.

8. The system of claim 1 wherein the system is utilized as part of a managed pressure drilling operation.

9. The system of claim 1 wherein the system is utilized as part of an underbalanced drilling operation.

10. The system of claim 1 wherein the mud pump has a minimum output flow rate greater than the second flow rate of the drilling mud delivered to the drill string.

11. A method for controlling drilling mud flow rate during drilling a subterranean formation, the method comprising:

deploying a drill string extending into a borehole, the drill string including a bottom hole assembly comprising a drill bit and at least one tubular;

providing a mud pump for pumping a drilling mud from a drilling mud source, through the drill string, out the drill bit and into an annular space created as the drill string penetrates the formation;

providing a plurality of chokes disposed down stream from the mud pump, the plurality of chokes comprising a first choke disposed between the mud pump and the drill string, and a second choke disposed between the mud pump and a mud tank; and, providing a fluid discharge conduit in fluid communication with the annular space for transferring the drilling mud to mud handling equipment in fluid communication with the mud tank;

wherein the first choke receives a first portion of the drilling mud from the mud pump at a first flow rate, wherein the first choke reduces the first flow rate of the first portion of the drilling mud to a second flow rate, wherein the second choke receives a combined flow of (i) a second portion of the drilling mud from the mud pump at the first flow rate, the second portion of the drilling mud bypassing the first choke from the mud pump, and (ii) a portion of the first portion of the drilling mud after exiting the first choke and bypassing the drill string, and wherein the second choke reduces a flow rate of the combined flow to a third flow rate.

12. The method of claim 11 further comprising providing a surface telemetry system for receiving data and transmitting commands to said bottom hole assembly, and wherein the bottom hole assembly further comprises sensors, and a telemetry system capable of receiving and transmitting data, including sensor data including at least pressure and temperature data.

13. The method of claim 11 further comprising selectively increasing annular space drilling mud pressure utilizing a fluid backpressure system connected to the fluid discharge conduit, wherein the fluid backpressure system comprises a flow meter, a fluid choke, a backpressure pump, and a drilling mud source.

14. The method of claim 13 wherein the second choke transfers the drilling mud at the third flow rate to the fluid backpressure system prior to the mud handling equipment and the mud tank.

15. The method of claim 11 wherein the mud tank is the mud source.

16. The method of claim 11 utilized as part of a managed pressure drilling operation.

17. The method of claim 11 utilized as part of an underbalanced drilling operation, and wherein a gas source is in fluid communication with the drilling mud at the second flow rate.

18. The method of claim 11 wherein the mud pump has a minimum output flow rate greater than the second flow rate of the drilling mud delivered to the drill string.

* * * * *